United States Patent [19]

Howe et al.

[11] 4,247,798

[45] Jan. 27, 1981

[54] MERCURY-METAL HALIDE DISCHARGE LAMP

[75] Inventors: Stephen H. Howe; Barry Preston; Robert B. Page, all of London, England

[73] Assignee: Thorn Emi Limited, London, England

[21] Appl. No.: 26,562

[22] Filed: Apr. 3, 1979

Related U.S. Application Data

[63] Continuation-in-part of Ser. No. 825,750, Aug. 18, 1977, abandoned.

[51] Int. Cl.[3] ..... H01J 61/22

[52] U.S. Cl. ..... 313/225; 313/229

[58] Field of Search ..... 313/229, 225

[56] References Cited

U.S. PATENT DOCUMENTS

| | | | |
|---|---|---|---|
| 3,234,421 | 2/1966 | Reiling | 313/225 X |
| 3,262,012 | 7/1966 | Koury et al. | 313/227 X |
| 3,911,308 | 10/1975 | Akutsu et al. | 313/229 X |
| 3,979,624 | 9/1976 | Liu et al. | 313/229 |

*Primary Examiner*—Palmer C. Demeo

*Attorney, Agent, or Firm*—Robert F. O'Connell

[57] ABSTRACT

Metal halide discharge lamps based on sodium and scandium iodides show improved color rendering without important loss of efficacy by the inclusion of lithium iodide, especially in the molar proportion of 10–50% LiI based on the total of Li, Na and Sc iodides. The ratio of alkali metal of SC iodides should be between 5.4:1 and 57.5:1. Especially preferred are lamps with less than 10 molar % ScI and the lamps may additionally contain caesium iodide to broaden the emission spectrum.

5 Claims, 2 Drawing Figures

MERCURY-METAL HALIDE DISCHARGE LAMP

CROSS-REFERENCE TO RELATED APPLICATION

Figure 1:
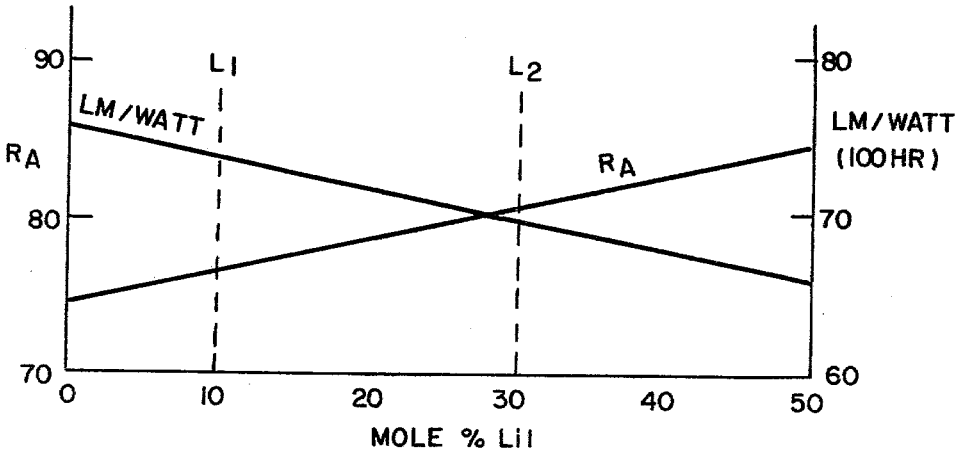

This application is a continuation-in-part of our application Ser. No. 825,750 filed Aug. 18, 1977, and now abandoned.

BACKGROUND OF THE INVENTION

The present invention relates to metal halide electric discharge lamps, that is to say, high-pressure electric discharge lamps having fills including mercury and metal halides.

Metal halide lamps have been known and manufactured for several years, and may exhibit an efficacy of about 65 Lm/watt through life, and a CIE general colour rendering index of about 72. For example, U.S. Pat. No. 3,407,327 to Koury et al discloses a metal halide lamp containing the halides of Hg, Sc, Th and an alkali metal, preferably Na.

Although the quality of the emitted light is satisfactory for many applications, the relative lack of red to deep red radiation as compared with other artificial light sources can make a conventional metal halide lamp unsuitable for certain critical applications. For example, satisfactory rendering of the colours of textiles and of fresh reddish foodstuffs, especially meat, demand a higher proportion of red radiation than is given by a standard sodium iodide-scandium iodide-caesium iodide-thorium iodide lamp, even when the lamp is provided with the most efficient red emitting phosphor known.

U.S. Pat. No. 3,911,308 to Akutsu et al teaches the addition of alkali metal halide, but especially sodium iodide, to scandium iodide lamps for the purpose of arc stabilization, lowering of the re-ignition voltage and improving the colour rendering. The use of alkali metals such as Na or Cs in stabilizing arcs in metal halide lamps is also described by Koury et al in U.S. Pat. No. 3,262,012.

U.S. Pat. No. 3,234,421 to Reiling discloses generally metal iodide lamps including iodides selected from those of Li, Na, Cs, Ca, Cd, Ba, Hg, Ga, In, Tl, Ge, Sn, Th, Se, Te and Zn, but is especially concerned with lamps containing sodium and thallium iodides. Lithium iodide is, however, corrosive and is known to attack the wall of the discharge vessel when employed in, for example, the sodium-indium-thallium iodide lamp described in British Pat. No. 1,125,063 or, indeed, in a high pressure lamp having a fill of mercury alone and no metal halide, as discussed in British Pat. No. 1,400,976.

U.S. Pat. No. 3,979,624 to Liu et al disclose metal halide lamps containing sodium and/or lithium iodides as well as scandium iodide, in which the molar ratio of alkali metal halide to scandium halide is from 1.7:1 to 5:1, resulting in enhanced efficacy, and teach that enhanced efficacy requires a low alkali metal to scandium ratio (below 5:1), contrasting this with the lamps of Koury et al No. 3 407 327, which show a $NaI:ScI_3$ molar ratio in excess of 11.5. The lamps of Liu et al do, however, have an undesirably high correlated colour temperature (CCT) for interior lighting applications, quoting a CCT of 5557° K. for their examples with Na and Li (column 6, lines 26–59) with $NaI+LiI:ScI_3$ ratios of 2:1 and 4.2:1. Their examples contain, respectively, 34.04 mole % LiI, 32.58% NaI and 33.33% $ScI_3$, 45.11% LiI, 21.56% NaI and 33.33% $ScI_3$, and 26.07% LiI, 54.66% NaI and 19.26% $ScI_3$.

SUMMARY OF THE INVENTION

We have now found, in contrast to the teachings of Liu et al., that the addition of lithium iodide to the fill of a metal halide lamp of the sodium-scandium-thorium iodide system with the optional inclusion of caesium, can result in an increase in the proportion of red radiation and enhanced colour-rendering while achieving an acceptable CCT value for interior lighting purposes (notably not exceeding 4500 K), and without impairment of the efficacy customarily achieved with lamps of this system.

Accordingly it is an object of this invention to provide a metal halide discharge lamp containing Na, Li, Sc and Th iodides having improved colour rendering and good efficacy while providing a colour appearance suitable for interior lighting applications.

In accordance with this invention this object is achieved by adding lithium iodide in such a quantity that the molar proportion of LiI to the total of $NaI+LiI+ScI_3$ is in the range 10 to 50% and the molar ratio of alkali metal iodide (NaI+LiI+optional CsI) to scandium iodide is between 5.4:1 and 57.5:1. In preferred lamps the molar ratio of alkali metal iodides to scandium iodide is greater than 11:1. The molar proportion of scandium iodide to the total Na, Li and Sc iodides is also preferably less than 10%.

Our experiments indicate that the lithium iodide should form between 10 and 50 mole % of the total iodides contributing the major light-emitting elements, to achieve the desired colour balance acceptable for the more critical applications. However, to maintain the most satisfactory luminous efficacy (for example 15000 lumens through life from a 250 W lamp) with the desired colour balance, it has been found that the lithium iodide should preferably lie in the restricted range of 10–30 mole % of the iodides contributing the major light-emitting elements, which in the present case are lithium, sodium and scandium.

By way of example, goods results have been obtained with 250 W high pressure metal halide lamps having the proportions of major light-emitting components in the ranges shown below. It is nevertheless to be appreciated that it is not necessary to add all components as the compounds themselves.

| | LiI | NaI | $ScI_3$ |
|---|---|---|---|
| Mole % | 10–50 | 81–43 | 9–7 |

If these proportions are expressed as percentages of the total metals (other than mercury) introduced into the lamp, calculated as iodides, the values are somewhat different, namely 10–30% LiI, 76–60% NaI and 7.4–7.7% $ScI_3$.

Caesium iodide is an optional component added to broaden the spectrum, and thorium is included primarily to promote electron emission, being usually applied as metal on the electrodes. The function of the mercury is to obtain the required operating pressure and electrical characteristics.

In the experiments referred to, the mercury content of the lamp was 27.7 $\mu$mole $cm^{-3}$, thorium 0.3 $\mu$mole $cm^{-3}$ and caesium iodide 0.77 $\mu$mole $cm^{-3}$. The components can, however, be varied as understood in the art, in order to achieve the desired operating characteristics.

Further improvements to the colour rendering of the lamp of this invention may be obtained by the use of mixtures of red and blue emitting phosphors on the inside of the outer bulb, in the manner known in the case of conventional lamps.

Figure 2:
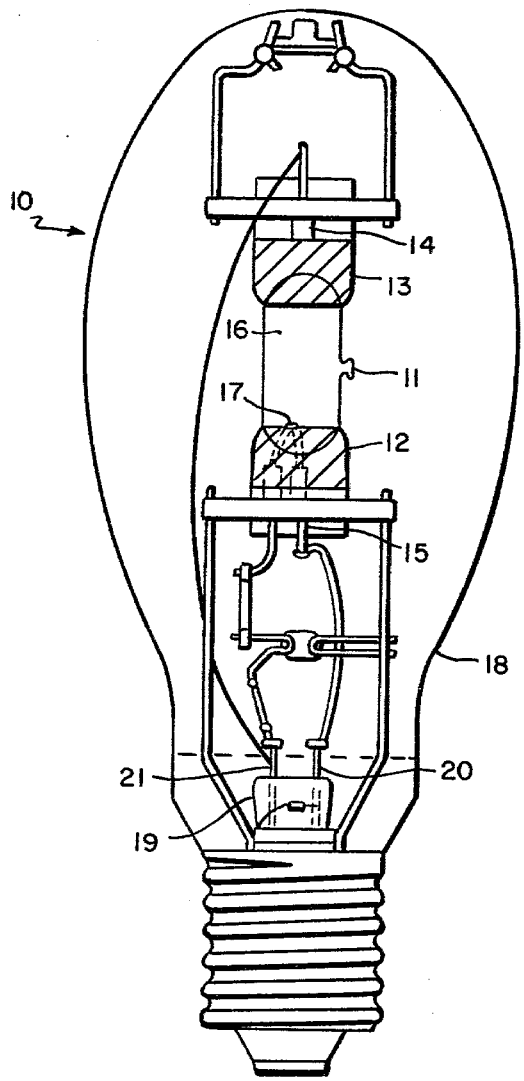

In the accompanying drawings:

FIG. 1 shows the colour rendering index $R_A$, and the efficacy at 100 hours (Lm/watt) plotted against lithium content in a Na-Sc-Cs iodide lamp; and FIG. 2 is a side elevation of a lamp embodying the invention.

A summary of the averaged photometric and colorimetric data taken after 100 hours life for the lamps in our experiments is given in Table 1. The variation of both luminous efficacy and general colour rendering index ($R_A$) with lithium iodide concentration is shown by the fair-fit lines plotted in FIG. 1. The lamps containing lithium iodide in the most preferred range of 10–30 mole % ($L_1$–$L_2$ in FIG. 1) have substantially improved colour rendering properties as judged by both the CIE figures and by the eye. Furthermore, it is to be noted that the luminous efficacy is only about 5–10% lower than that of the unmodified lamp.

TABLE 1

Summary of Photometric and Colorimetric Data

| MOLE % LiI | CIE COLOUR RENDERING INDICES GENERAL $R_A$ | CIE COLOUR RENDERING INDICES SPECIAL $R_8$ | *BAND 8 % LUMINANCE (660–760 nm) | +BAND 6 % LUMINANCE (620–760 nm) | LM/WATT (100 HR) |
|---|---|---|---|---|---|
| 0 | 74 | 37 | 0.25 | 5.63 | 76 |
| 10.2 | 75 | 45 | 0.47 | 5.8 | 74 |
| 15.2 | 77 | 49 | 0.53 | 6.0 | 73 |
| 20.1 | 76 | 49 | 0.54 | 6.0 | 72 |
| 29.9 | 82 | 57 | 0.62 | 6.1 | 70 |
| 48.8 | 84 | 63 | 0.68 | 5.7 | 66 |

*CIE (1948) 8 BAND SYSTEM
+CRAWFORD 6 BAND SYSTEM

An example of the lamp construction employed in our experiments is shown in FIG. 2 of the drawings.

The lamp 10 has a power output of approximately 250 watts during operation and comprises a quartz glass discharge vessel 11 with pinches 12 and 13, one at each end of the vessel 11, through which current supply elements 14 and 15 are sealed. These current supply elements 14 and 15 are connected within the discharge vessel 11 to tungsten electrodes 16 and 17 between which the discharge takes place during operation. The discharge vessel 11 is placed in an envelope 18 which is filled with an inert gas. The envelope 18 is made of a hard glass and has a pinch 19 at one end through which current supply wires 20 and 21 have been passed in a vacuum-tight manner. The current supply wires 20 and 21 are connected to the current supply elements 14 and 15. The discharge vessel 11 has an internal diameter of 14 mm and an arc length of 23 mm and contains an inert gas, mercury and thorium, together with sodium, scandium and optionally caesium iodides, as well as lithium iodide in accordance with this invention.

Two specific examples of the preparation and performance of lamps of the type shown in FIG. 2 will now be described.

EXAMPLE 1

The discharge vessel 11 of a lamp as described above with reference to FIG. 2 is filled with Hg—22 mg
NaI—7 mg
LiI—3 mg
Sc—0.5 mg
$HgI_2$—4 mg
Th—0.4 mg and with argon to a pressure of 60 torr.

A phosphor was used comprising a mixture of 0.7 g europium activated yttrium vanadate (red emitting) and 0.9 g of strontium chloroapatite (blue emitting).

The fill formulation corresponds to mole percentages of Li, Na and Sc iodides of 29.89% LiI, 62.28% NaI and 7.83% $ScI_3$ and a ratio of LiI+NaI:$ScI_3$ of 11.78:1.

A light output of 68 lm/W, and a colour temperature T of 4500 K for the emitted radiation, were measured on this lamp. The CIE general colour rendering index (1974 method) was found to be $R_A=81$ The CIE (1948) eight band % luminance data were

| Band No. | 1 | 2 | 3 | 4 | 5 | 6 | 7 | 8 |
|---|---|---|---|---|---|---|---|---|
| % Luminance | 0.01 | 0.12 | 0.50 | 9.28 | 36.40 | 44.29 | 8.64 | 0.71 |

EXAMPLE 2

The discharge vessel 11 of a lamp as described was filled with

Hg—23 mg
NaI—9 mg
LiI—1 mg
Sc—0.5 mg
$HgI_2$—4 mg
Th—0.4 mg CsI—1 mg and with argon to a pressure of 60 torr. A phosphor comprising a mixture of 0.6 g of europium activated yttrium vanadate and 0.3 g of strongium calcium magnesium phophate (SCMP) was employed.

The fill formulation corresponds to mole percentages of 10.18% LiI, 81.82% NaI and 8.0% $ScI_3$ or, if CsI is included in the reckoning, 9.67% LiI, 77.75% NaI, 7.60% $ScI_3$ and 4.98% CsI. The molar ratio of alkali metal iodide to scandium iodide is 12.16:1.

A light output of 74 lm/W and a colour temperature T of 3900 k were measured. For this lamp, $R_A=75$ Eight band % luminance data were

| Band No. | 1 | 2 | 3 | 4 | 5 | 6 | 7 | 8 |
|---|---|---|---|---|---|---|---|---|
| % Luminance | 0.02 | 0.20 | 0.20 | 7.51 | 34.83 | 47.12 | 9.65 | 0.47 |

For comparison, the results at 100 hours life for a typical Na-Sc-Cs halide lamp without lithium addition and with a mixture of 0.6 g of europium activated yttrium vanadate and 0.3 g of SCMP as phosphor were a light output of 76 lm/W and a colour temperature of 3900 K, and an $R_A$ of 75.

Eight band % luminance data for this typical lamp were

| Band No. | 1 | 2 | 3 | 4 | 5 | 6 | 7 | 8 |
|---|---|---|---|---|---|---|---|---|
| % Luminance | 0.02 | 0.19 | 0.26 | 7.59 | 34.48 | 48.5 | 8.69 | 0.25 |

Fills for other lamps embodying the invention can readily be formulated to give a desired performance. As will be apparent from the relationships demonstrated in FIG. 1, the lithium iodide content can be selected to obtain a chosen balance between the colour rendering properties and the luminous efficacy. Moreover, modification of the $R_A$ value is possible by variation of the phosphor, in accordance with known techniques.

We claim:

1. In a metal halide electrical discharge lamp comprising a sealed light-transmitting envelope, electrodes therein, current leads for said electrodes and a fill within said envelope comprising mercury, an inert gas, thorium, the iodides of and sodium and scandium, the improvement comprising the inclusion in the fill of a molar proportion of lithium iodide in the range of 10 to 50% of the total of sodium, lithium and scandium iodides, and the molar ratio of the total alkali metal iodides present to scandium iodide is between 5.4:1 and 57.5:1.

2. The lamp of claim 1 in which the molar ratio of said alkali metal iodides to scandium iodide exceeds 11.0:1.

3. The lamp of claim 2 in which the molar proportion of scandium iodide is less than 10% of the total sodium, lithium and scandium iodides.

4. The lamp of claim 1 in which the lithium, sodium and scandium iodides are present in the molar proportions of 10–50% LiI, 81–43% NaI and 9–7% $ScI_3$, expressed as percentages of the total of sodium, lithium and scandium iodides.

5. The lamp of claim 1 in which the alkali metal iodides are present additionally include cesium iodide.

* * * * *